United States Patent [19]

Wright

[11] 4,121,439

[45] Oct. 24, 1978

[54] KNITTING MACHINES

[75] Inventor: Dennis Wright, Aylestone, England

[73] Assignee: Wildt, Mellor Bromley Limited, England

[21] Appl. No.: 696,114

[22] Filed: Jun. 15, 1976

[30] Foreign Application Priority Data

Jun. 16, 1975 [GB] United Kingdom ..... 25661/75

[51] Int. Cl.[2] ..... D04B 15/60

[52] U.S. Cl. ..... 66/140 R; 66/152

[58] Field of Search ..... 66/140 R, 134, 172 R, 66/131, 171, 147, 152

[56] References Cited

U.S. PATENT DOCUMENTS

| | | | |
|---|---|---|---|
| 2,022,744 | 12/1935 | Shalette | 66/171 |
| 2,023,633 | 12/1935 | Bentley et al. | 66/134 |
| 2,139,754 | 12/1938 | Houseman | 66/140 R |
| 2,549,701 | 4/1951 | Mishcon et al. | 66/140 R |
| 2,940,285 | 6/1960 | Saunders | 66/140 R |
| 3,472,048 | 10/1969 | Shaw et al. | 66/147 |
| 3,521,466 | 7/1970 | Tannert | 66/19 |
| 3,640,094 | 2/1972 | Piana et al. | 66/147 |
| 3,823,582 | 7/1974 | Butler | 66/147 |
| 3,832,869 | 9/1974 | Shields | 66/177 X |
| 3,834,191 | 9/1974 | Fregeolle | 66/177 X |
| 3,926,015 | 12/1976 | Sangiacomo | 66/147 |
| 3,975,926 | 8/1976 | Tenconi | 66/19 X |

FOREIGN PATENT DOCUMENTS

| | | | |
|---|---|---|---|
| 850,642 | 9/1952 | Fed. Rep. of Germany | 66/152 |
| 1,118,547 | 7/1968 | United Kingdom | 66/152 |

*Primary Examiner*—Wm. Carter Reynolds
*Attorney, Agent, or Firm*—Irving M. Weiner

[57] ABSTRACT

In a knitting machine the needle beds and yarn feeders circulate relative to one another. This normally produces a tubular fabric. In order to leave a gap in the tube, a zone of each needle bed is arranged as a non-knit zone. To save yarn the yarns are not normally allowed to float across the gap, but are severed and trapped. To hold the edges straight, periodic yarns are allowed to float across the gap.

8 Claims, 6 Drawing Figures

KNITTING MACHINES

This invention relates to knitting machines of the type comprising needle beds and yarn feeding means which circulate relative to one another, the needle beds having a non-knit zone, i.e., a zone in which the needles are inoperative or from which they have been removed or a zone which is not capable of receiving needles, means for severing the yarn in the non-knit zone, and means for presenting yarn to the first needle to knit following the non-knit zone.

A machine of the type referred to may be, for example, a circular knitting machine in which the beds (cylinder and dial) are stationary while the yarn feeding means rotates, or in which the beds rotate while the yarn feeding means is stationary, or a knitting machine having two (or more) stationary straight sections provided with needles, the straight sections being joined at their ends by arcuate needle-free sections. If the non-knit zone is a zone from which needles have been removed, its extent can be varied by adding or subtracting needles.

In known machines of the type referred to, the yarn is severed in the non-knit zone after every course of knitting, thus leaving fringe yarns at the edges of the fabric. The fabric edges tend to bow inwardly or laterally and this can cause difficulty. For example, the bowing of the fabric edges causes the wales in the fabric in the region of the edges to slope diagonally away from the needles, and in machines having means for transferring loops from one needle bed to the other, such slanting of the wales and consequential slanting of the loops on the needles makes transfer more difficult.

The present invention provides a knitting machine of the type referred to, in which the majority of courses are knitted with the yarn being severed in the non-knit zone, thus leaving a fringe of yarns along the edges of the fabric, and means for ensuring that, at spaced intervals, the yarn severing means is rendered ineffective so that the yarns are left unsevered in the non-knit zone, thus joining the edges of the fabric together at spaced intervals.

In another aspect, the invention provides a method of knitting a fabric on a knitting machine of the type referred to, the method comprising repeatedly severing yarn in the non-knit zone and presenting yarn to the first needle to knit following the non-knit zone, thus leaving a fringe of yarns along the edges of the knitted fabric, and periodically, after a plurality of courses have been knitted, allowing the yarn to remain unsevered in the non-knit zone, so that the edges of the knitted fabric are joined together at spaced intervals.

In a preferred embodiment the machine is a circular knitting machine having a stationary needle-cyclinder and a stationary needle-dial, the yarn being fed to the needles by one or more rotating yarn-feeders. A plurality of courses, preferably about twelve, are knitted with the yarn being cut every time it enters the non-knit zone and the yarn then being presented to the first needle to knit following the non-knit zone. Then, after the knitting of the next course, the yarn feeder is lowered as it passes the last needle to knit, but the yarn severing means is rendered ineffective and the yarn floats across the non-knit zone low enough to pass under the dial. This procedure is repeated to give a sequence of knitting in which a single yarn float is produced, for example, every twelve courses, in order to bridge the gap between the fabric edges. The resulting series of spaced floats maintains the fabric in a tube and inhibits bowing of the edges.

In the machine according to the invention, it may be advantageous to provide a guide plate for supporting the unsevered yarn or float joining the fabric edges, in order to maintain the fabric edges in a plane parallel to the axis of the fabric tube as they are cast off the needles. In a circular knitting machine, the guide plate may be rigid with the dial, e.g. being in the form of a flange, which may be arcuate. In the absence of such a flange the floats extend as chords between the fabric edges and might tend to slighly distort the loops on the needles adjacent the non-knit zone. The guide plate is preferably of sufficient extent (in the direction of motion of the fabric tube) to support a plurality of floats.

The yarn may be severed by a cutter associated with the yarn feeding means or a cutter associated with the non-knit zone. Cutting preferably occurs as soon as is practicable after the yarn has left the last needle to knit, since this maximizes the saving of yarn. The fringe yarns projecting from the edges of the fabric tend to be drawn into the fabric during knitting of subsequent courses, so it is usually desirable to provide devices for trapping the fringe yarns temporarily. A number of such devices are already known. However, the preferred device is that described in our U.S. Pat. No. 3,995,456: that device is mounted immediately following the last needle to knit or immediately preceding the first needle to knit and comprises a pair of yarn gripping jaws, one jaw being fixed, the other being radially movable and urged into contact with the fixed jaw by resilient means, and a cam-operated mechanism for temporarily moving the moveable jaw out of contact with the fixed jaw against the action of the resilient means in order to allow insertion of a fringe yarn between the jaws and release of a fringe yarn from the jaws. Whenever the yarn is left unsevered in order to form a float, the yarn is not inserted into the trapping device.

The knitting machine according to the invention will usually include means for drawing off the knitted fabric from the needle beds. Conveniently, the machine may include yarn trimmers arranged upstream of the drawing-off means so as to trim both the fringe yarns and the floats close to the terminal wales of the knitted fabric. The drawing-off means will usually act on the double-layer thickness of fabric, and the absence of one layer of knitted fabric (due to the non-knit zone) will result in a single-layer thickness being acted on by a lower drawing-off force. Preferably, then, the drawing-off means includes rolling means acting only in the region of a single-layer thickness of fabric. The rolling means may comprise an elongated roller or a series of co-axial rollers. The roller(s) may be mounted on a drive shaft and may comprise removable sleeves retained by longitudinally adjustable collars. The roller(s) or the collars may be adapted and arranged to provide guiding means cooperating with the fabric edges.

To facilitate trimming of the fringe yarns and floats of the fabric, needles may be removed or rendered inoperative near the non-knit zone in order to create, at each edge of the fabric, a "float wale" displaced inwards about, for example, two needle-pitches from the fringe yarns. The fabric can then be trimmed along the "float wales".

The invention will be described further, by way of example only, with reference to the accompanying drawings.

DETAILED DESCRIPTION

Figure 1:
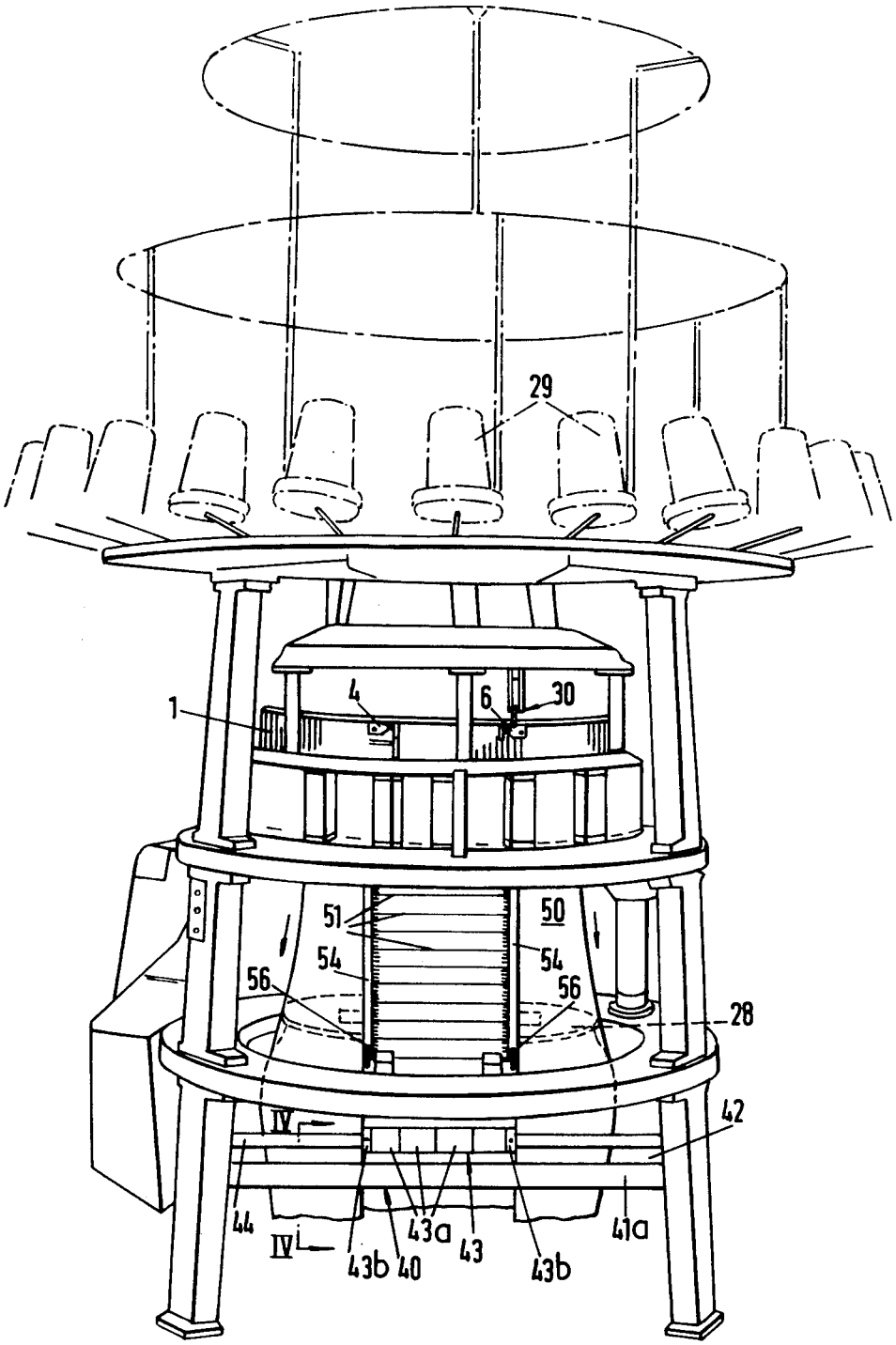
FIG. 1 is a diagrammatic general view of a circular knitting machine according to the present invention.
Figure 4:
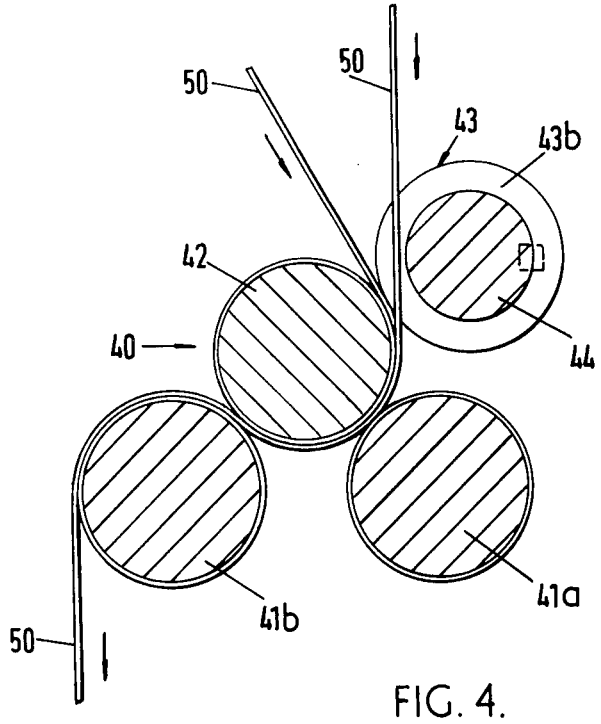
FIG. 4 is a section on line IV—IV of FIG. 1, showing a drawing-off device.

The circular knitting machine illustrated has a stationary needle cylinder 1 with verge walls 1*a*, needle tricks 1*b*, and needles 2. Above and within the needle cylinder circle is situated a stationary dial having similar verge walls and slots carrying dial needles 3. Yarn is fed to the needles from bobbins 29 by yarn feeding units 30, only one of which is shown in FIG. 1. The generally tubular knitted fabric 50 is drawn off over an oval fabric tensioning or stretching board 28 by a device 40 comprising pressure rollers 41*a*, 41*b* (FIG. 4).

The needle cylinder tricks 1*b* terminate at a level 1*c* below the verge walls 1*a* and there is thus a smooth cylindrical zone between the needle tricks 1*b* and the verge walls 1*a*. A trapping device 4 is located in this zone and is adjacent to the last needle to knit (needle 2') in an arc of needles (not shown). A similar trapping device 6 is located adjacent to the first needle to knit.

A tenon slot 5 is formed around the smooth cylinder zone of the needle cylinder 1 and the trapping devices 4 and 6 are mounted on the cylinder 1 by means of this slot. The trapping device 4 includes a support plate 7 secured by the screws 8 to a tenon (not shown) fitted in the slot 5 thus locking the plate 7 to the needle cylinder 1 in a releasable manner allowing circumferential positioning of the trapping device.

An intermediate plate or jaw 11 having a raised, corrugated clamping zone 11*a* comprising vertical ridges can move to and fro between the fixed plate 7 and a front plate or jaw 13 rigid with the plate 7.

Figure 2:
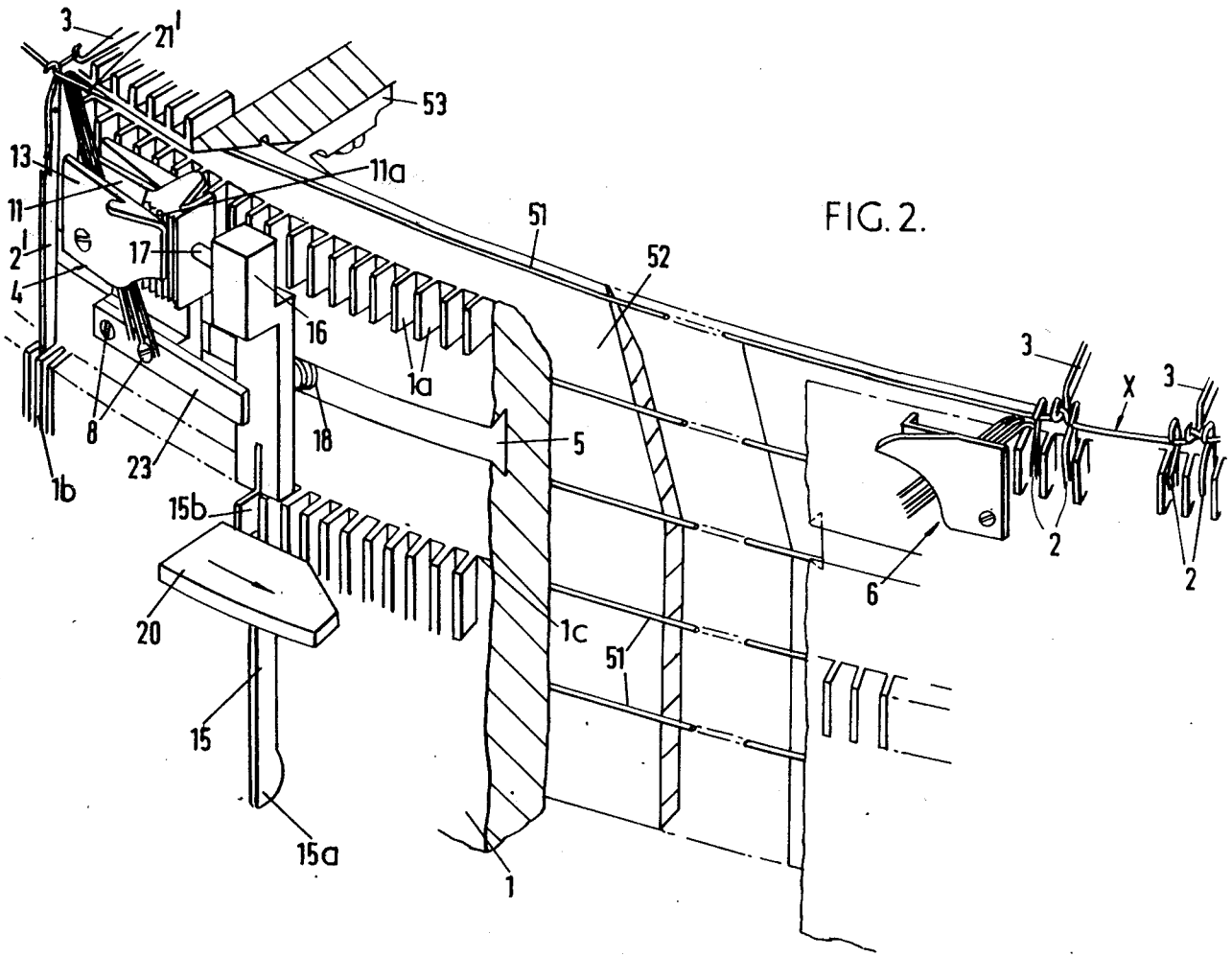
FIG. 2 is a fragmentary perspective view of a non-knit zone of the machine.

The mechanism for moving the clamping jaw 11 radially comprises a blade-like element 15 (which is inserted in a needle trick as shown in FIG. 2) having an integral or rigid block 16 from which a rod 17 projects laterally. The rod 17 is located in the clamping jaw 11 and thus by oscillating the element 15 on its fulcrum 15*a*, the clamping zone 11*a* can be caused to move into and out of contact with the fixed jaw 13. A spring 18 is located in the tenon slot 5 and serves (via the block 16) to urge the clamping zone 11*a* into contact with the jaw 13. For opening the jaws, a butt 15*b* is provided on the element 15, which can be contacted by a cam 20 rotating with the yarn feeding unit, whereby the element 15 is rocked back into the needle trick thus further compressing the spring 18. To prevent the spring 18 forcing the element 15 out of its trick when the clamping zone 11*a* is pressed against the jaw 13, an arm 23 secured to the support plate 7 by the screws 8 projects in front of the element 15 and block 16 to limit movement of the block 16.

Figure 3:
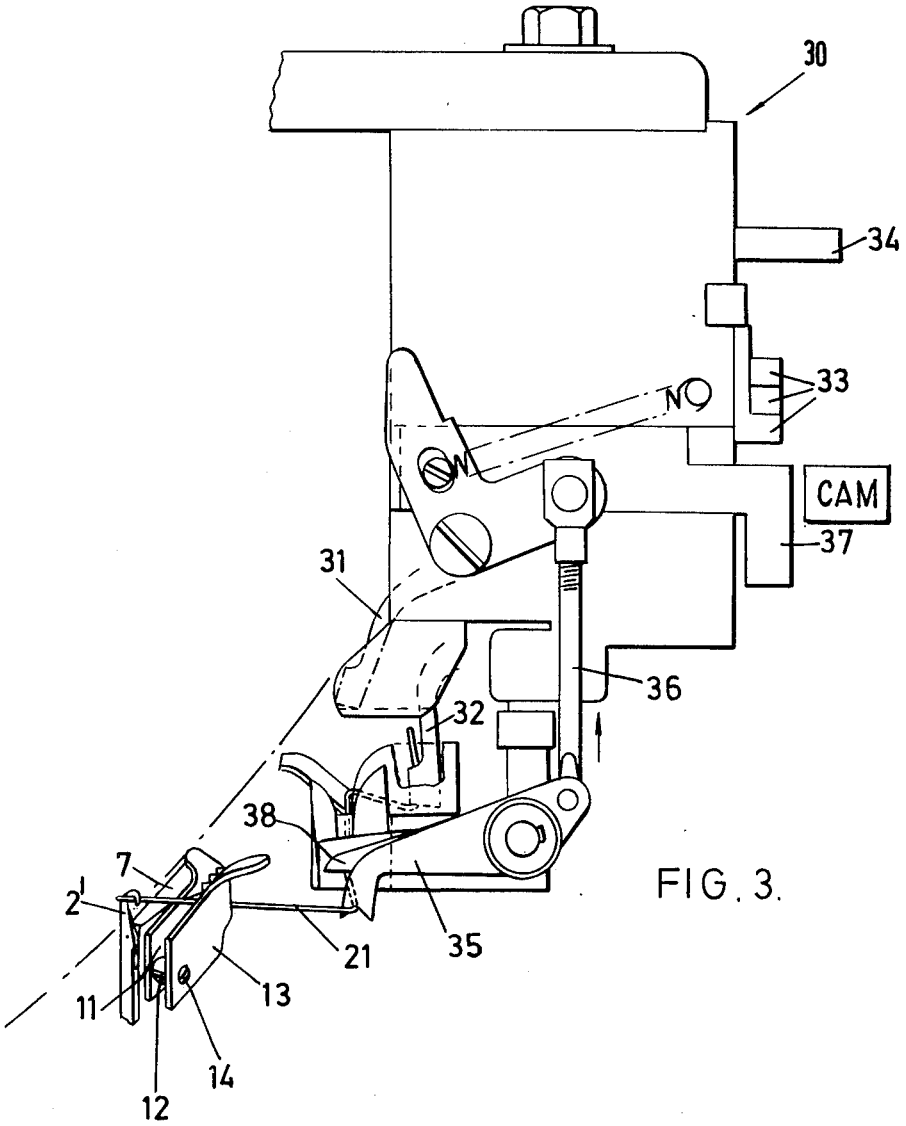
FIG. 3 shows one of the yarn feeding units of the machine.

In FIG. 3 part of the trapping device 4 is shown in conjunction with the last needle 2' to knit and a conventional yarn feeding unit 30. This unit 30 has yarn feeders (only two of which, 31, 32 are shown) which can each be supplied with yarn, the feeder 31 being shown in the raised (operative) position, the feeder 32 being in the lowered (inoperative) position. The feeders are selected by stationary cams (not shown) cooperating with cam followers 33 on the rotating yarn feeding unit, and are withdrawn by slides 34 cooperating with fixed cams (not shown).

The yarn 21 coming from the last needle 2' is seen in FIG. 3. The yarn 21 has been fed to the needles by the feeder 32 which, before passing the trapping device, was in the operative position. As the feeding unit 30 passes the trapping device, the jaws 11, 13 are opened by the cam 20. Subsequently, the yarn 21 is lowered by the feeder 32 and is pushed down between the jaws 11, 13 by a placer 35 actuated through a linkage 36 by a slide 37 operated by a cam. A cutter 38 descends at the same time as the placer 35 and cuts the yarn 21 so as to leave a fringe yarn which is immediately afterwards gripped between the jaws 11, 13 as the butt 15*b* (FIG. 2) is released by the cam 20. Whenever the jaws 11, 13 are out of contact, the preceding fringe yarns are free to escape into a permanent recess between jaws 11, 13 (defined by a spacer 12 — FIG. 3) from where they freely move up under the effect of the continuous downward and radially inward movement of the knitted fabric.

The above described severing and trapping procedure is performed for twelve successive courses of knitting, and at the end of the twelfth course the yarn is trapped and severed as the yarn feeding unit passes the last needle to knit. The yarn placer 35 is raised as the feeder unit passes the non-knit zone. The thirteenth course is commenced (on the first needle following the non-knit zone) by the yarn feeder 32 being raised to introduce its yarn to the needles and knitting of the thirteenth course proceeds. Now in order to ensure that the yarn placer does not lower the yarn as the feeder unit passes the last needle to knit the placer is lowered prematurely by an auxiliary control cam 39 (FIG. 6) which is brought into action by means of a stud on a control chain (not shown). This cam 39 operates upon the slide 37 which causes the yarn placer 35 and cutter 38 to move to the position shown in FIG. 6.

Figure 6:
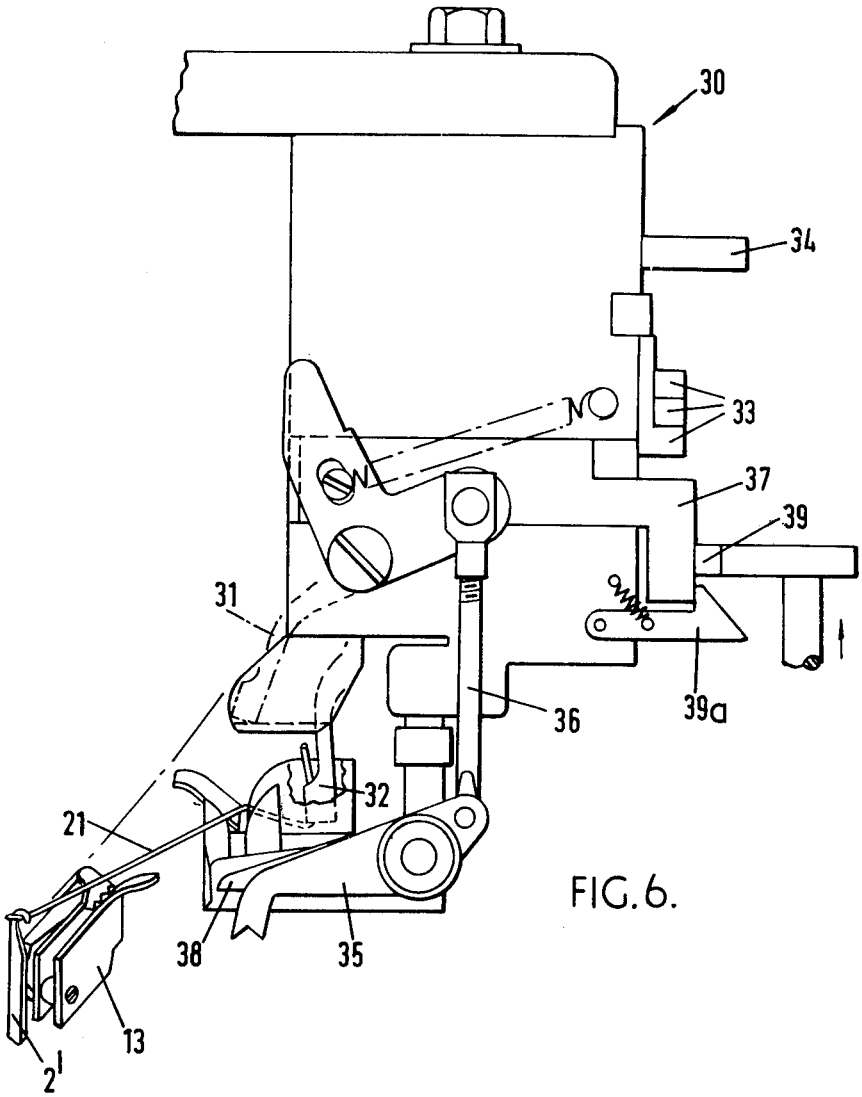
FIG. 6 is a view similar to FIG. 3 showing some additional components.

The placer and cutter are held in this position by means of a spring loaded latching member 39*a*. It should be noted that if a single yarn feeding unit having a latch member 39*a* makes a specified number of revolutions around the needle cylinder, a specified number of knitted courses are produced, together with their cut fringe yarns at the needle free zone as follows. The auxiliary cam 39 is kept down in a low position. The slide 37 is advanced by a permanent cam which is situated adjacent the commencement of the needle free zone, thus the yarn placer 35 and the cutter 38 are operated to cut the yarn each time the unit enters the needle free zone. The latching member 39*a* is active at each advance of slide 37, but is unlatched after each cutting and trapping operation. Therefore, if a machine is provided with only one feeding unit 30 and a floated yarn is required after every specified number of courses, then the auxiliarly cam 39 will be raised to active position as shown in FIG. 6 prior to the commencement of the next course. It should be mentioned that this action takes place upon only one selected yarn feeding unit 30, and the placer and cutter are held in this position while the feeding unit travels around the needle cylinder. When the feeding unit 30 reaches the start of the non-knit zone, the feeder 32 is lowered from the operative position to the position shown in FIG. 6. As the placer 35 has already been lowered (prematurely) to the position shown in FIG. 6, the yarn 21 extending from the last needle 2' is not taken down into the trapping and severing means, the feeding unit 30 continues to supply yarn while traversing the needle free zone thus forming a float 51 which passes under the periphery of the dial. A fixed cam (not shown) is used to operate upon the latching member 39*a* for releasing the slide 37 and thereby resetting the placer 35 and cutter 38 before the severing and trapping procedure commences.

The severing and trapping procedure is then repeated for the next 12 courses, before another single float 51 is formed. The floats 51 are supported by an arcuate guide plate 52 which is fixed to the underside of the dial by brackets 53 (only one shown) and extends across the whole of the non-knit zone. The external surface of the plate 52 slopes inwardly and downwardly in its upper part, while the lower part is vertical.

To facilitate subsequent trimming of the knitted fabric, longitudinal unlooped zones, which can conveniently be termed "float wales" 54 are formed near the edges of the fabric (FIG. 1) by removing needles from a position about two needle-pitches inwards from the non-knit zone. One such position is indicated at X in FIG. 2; needles would also be removed from the equivalent position in relation to the needle 2'.

Figure 5:
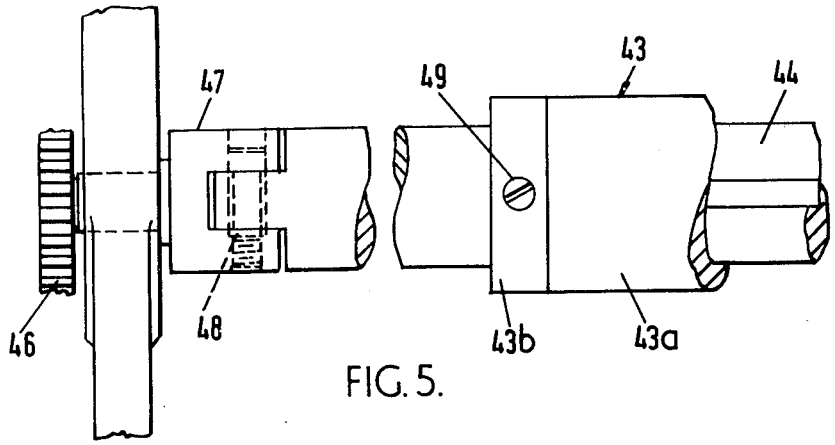
FIG. 5 is a fragmentary view of an auxiliary roller of the drawing-off device.

Immediately after passing over the stretching board 28 the fabric 50 is trimmed by cutters 56 along the respective float wales 54. The fabric 50, initially generally tubular, is flattened as it passes through the drawing-off device 40 (FIGS. 1, 4 and 5) which is directly below the stretcher board 28. The double-layer thickness of fabric is acted on by the two driven pressure rollers 41*a*, 41*b* on one side and a driven counter-roller 42 on the other side. Rolling means in the form of an elongated roller 43 on a driven shaft 44 act on the single-layer thickness of fabric, in conjunction with the counter-roller 42. The shaft 44 is rotated by a co-axial driven gear 46 rigid with a stub axle 47 releasably connected to one end of the shaft 44 by a transverse bolt 48; the other end of the shaft 44 is similarly connected to a stub axle.

The roller 43 comprises removable segments or sleeves 43*a*, keyed on the shaft 44, and a pair of collars 43*b* which retain the sleeves 43*a* on the shaft and are themselves retained by respective set-screws 49. As can be best seen in FIG. 1, the axially outer surfaces of the collars 43*b* serve as means for guiding the trimmed edges of the fabric 50.

Various modifications may be made within the scope of the invention. In particular, the number of fringe yarns and floats can be varied, as can the ratio between these two numbers; for example, there may be more than twelve fringe yarns between the floats. It is also permissible to provide more than one successive course with floats, although this is unlikely to provide any advantage over a single float.

I claim:

1. In a knitting machine comprising needle beds with needles and yarn feeding means which circulate in relation to one another, the needle beds having a non-knit zone, means for severing the yarn in the non-knit zone, and means for presenting said yarn to the first needle to knit following the non-knit zone, the improvement of:

means to ensure that the majority of courses are knitted with said yarn being severed in the non-knit zone and presented to said first needle to knit following said non-knit zone, thus leaving a fringe of severed portions of said yarn along the edges of the fabric, and means for ensuring that, at spaced intervals, the yarn severing means is rendered ineffective so that said yarn is left unsevered in the non-knit zone, thus joining the edges of the fabric together at spaced intervals; and a device for trapping the severed yarns in the region of the non-knit zone.

2. A knitting machine as claimed in claim 1, comprising placer means for bringing the yarns into a path where they can be severed, and wherein the ensuring means includes means for rendering the placer means ineffective.

3. A knitting machine as claimed in claim 2, in which the yarn is moved into the path of the placer means by the yarn-feeding means at the commencement of the non-knit zone, and wherein the placer means may be operated before the yarn is moved into its path, thereby rendering it ineffective.

4. A knitting machine as claimed in claim 1, comprising a guide plate for supporting the unsevered yarn or float joining the fabric edges, in order to maintain the fabric edges in a plane parallel to the axis of the fabric tube as they are cast off the needles.

5. A knitting machine as claimed in claim 1, comprising a draw-off device including rollers operating on a double-layer thickness of knitted fabric and an additional rolling means acting only in the region of a single-layer thickness of fabric.

6. A knitting machine as claimed in claim 1, in which needles are removed or rendered inoperative near the non-knit zone in order to set up a float wale just inwardly of the fringe yarns.

7. In a knitting machine comprising needle beds and yarn feeding means which circulate in relation to one another, the needle beds having a non-knit zone, means for severing the yarn in the non-knit zone, and means for presenting yarn to the first needle to knit following the non-knit zone, the improvement of:

means to ensure that the majority of courses are knitted with the yarn being severed in the non-knit zone, thus leaving a fringe of yarns along the edges of the fabric, and means for ensuring that, at spaced intervals, the yarn severing means is rendered ineffective so that the yarns are left unsevered in the non-knit zone, thus joining the edges of the fabric together at spaced intervals, and comprising a draw-off device including rollers operating on a double-layer thickness of knitted fabric and an additional rolling means acting only in the region of a single-layer thickness of fabric; and said additional rolling means comprising an elongated roller consisting of a drive shaft, removable sleeves mounted on said drive shaft and longitudinally adjustable collars also mounted on said drive shaft and up to said sleeves.

8. A knitting machine as claimed in claim 7, in which said collars are arranged to provide guiding means cooperating with the fabric edges.

* * * * *